United States Patent [19]

Morgan

[11] Patent Number: 4,473,009

[45] Date of Patent: Sep. 25, 1984

[54] APPARATUS FOR VARYING THE POSITION OF A PRINTING OPERATION PERFORMED ON A WEB

[76] Inventor: John H. Morgan, Kingswood House, Wotton Rd., Kingswood, Wotton-under-Edge, Gloucestershire, England

[21] Appl. No.: 358,632

[22] Filed: Mar. 16, 1982

[30] Foreign Application Priority Data

Mar. 18, 1981 [GB] United Kingdom ..... 8108393
Jan. 26, 1982 [GB] United Kingdom ..... 8202112

[51] Int. Cl.[3] ..... B41F 13/24

[52] U.S. Cl. ..... 101/232; 101/181; 226/40

[58] Field of Search ..... 101/232, 235, 178, 180, 101/181, 224, 225, 227, 228; 226/29, 30, 40, 41, 28, 31, 45, 111, 188–189

[56] References Cited

U.S. PATENT DOCUMENTS

| | | | |
|---|---|---|---|
| Re. 28,602 | 11/1975 | Clark | 226/40 |
| 2,296,979 | 9/1942 | Byrne | 226/41 |
| 2,549,605 | 4/1951 | Hulu | 226/40 X |
| 2,866,407 | 12/1958 | Hackel et al. | 226/40 |
| 2,897,754 | 8/1959 | Spiller et al. | 226/41 X |
| 3,147,900 | 9/1964 | Konkel | 226/40 |
| 3,152,542 | 10/1964 | Chambon | 101/181 |
| 3,179,045 | 4/1965 | Evers | 226/40 |
| 3,329,087 | 7/1967 | Sandor et al. | 101/181 |
| 3,561,654 | 2/1971 | Greiner | 226/40 |
| 3,841,216 | 10/1974 | Huffman | 101/181 |

FOREIGN PATENT DOCUMENTS

| | | | |
|---|---|---|---|
| 126868 | 10/1979 | Japan | 226/29 |
| 1262116 | 2/1972 | United Kingdom . | |
| 1399394 | 7/1975 | United Kingdom . | |
| 1540409 | 2/1979 | United Kingdom . | |
| 2013570 | 8/1979 | United Kingdom . | |

*Primary Examiner*—E. H. Eickholt
*Attorney, Agent, or Firm*—Murray Schaffer

[57] ABSTRACT

The apparatus comprises a printing cylinder for printing an element such as a paper web and feed and take-up rollers for the web. Sensors are provided for sensing the relative positioning of the web and the print which is applied to the web and the signals from the sensors are fed to a micro-processor. The micro-processor controls the feed and take up rollers so that if the relative positioning of the web is incorrect, the feed and take-up rollers are controlled simultaneously to move the web relative to the printing cylinder substantially without varying any tension in the web between the feed roller and the take-up roller.

7 Claims, 5 Drawing Figures

APPARATUS FOR VARYING THE POSITION OF A PRINTING OPERATION PERFORMED ON A WEB

Figure 1:
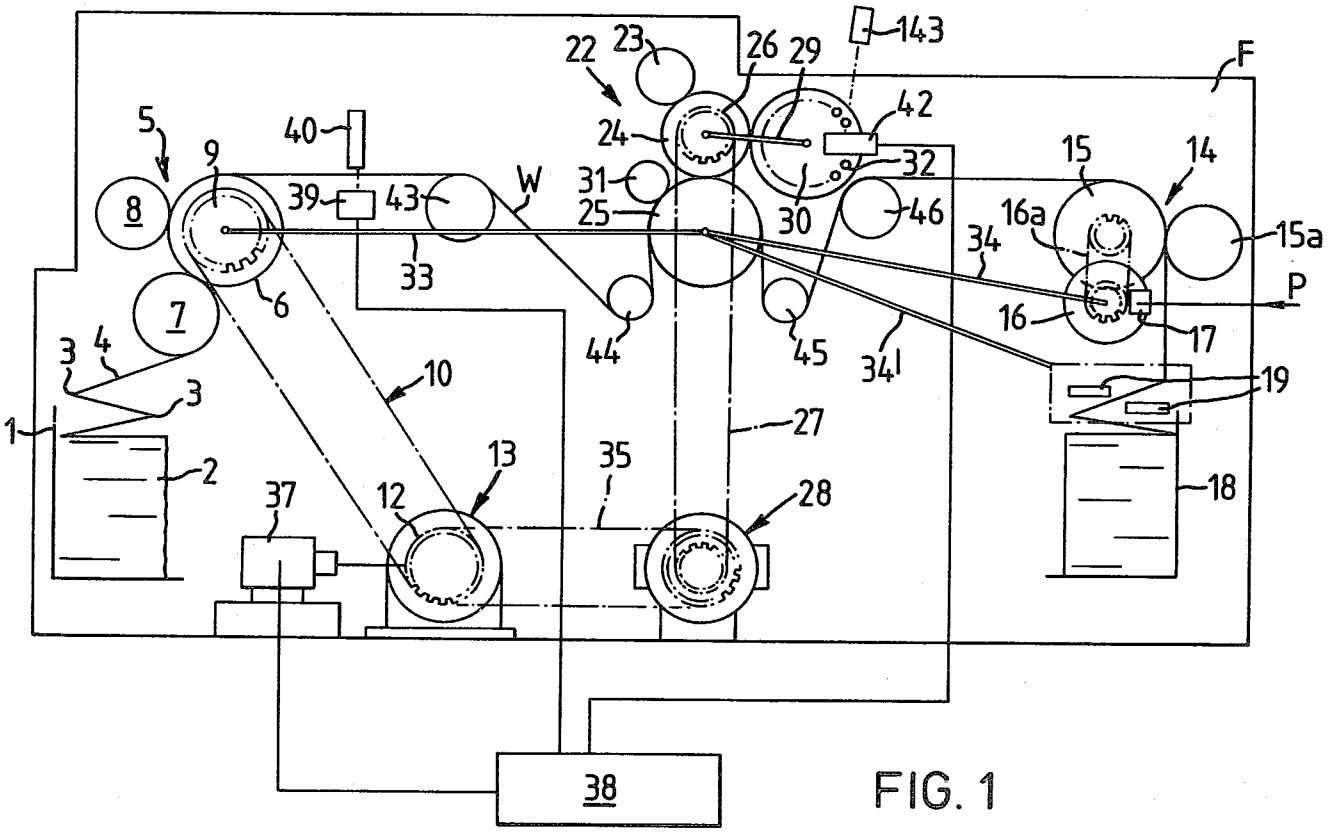

The invention relates to apparatus for and method of varying the position of an operation performed on a moving element such as a web of material.

In the field of printing, and particularly in the field of printing matter on a paper web for use in a computer print-out machine, printed matter often has to be applied to the web with extreme accuracy. When printing a pre-processed paper web for use in computer print-out machines, the paper web generally comprises a length of paper which has numerous evenly spaced transverse perforations to define interconnected sheets and which enables the web to be arranged as a concertina-like stack. Where a computer user requires certain basic printed matter to appear on every sheet of the stack it is essential to ensure that the printed matter is placed in a precise position on each sheet so that the printed matter aligns accurately with the print applied by the computer print-out machine.

When printing the desired matter on the web, it is common practice to pass it between blanket and impression cylinders of a printing machine so that the printed matter will be applied to the web between the transverse perforations. However, a problem arises in that the circumference of the blanket cylinder is always constant but does not always match exactly with the spacing of the perforations on the web. Therefore, after a period of time, misregistration occurs as the printed matter on the web "drifts" from the the initial correct position and it is highly desirable to avoid that disadvantage.

It is known in the art to alter the position at which print is applied to a moving web of material to correct mis-registration of the web so as to vary its position relative to a printing roller by applying varying tension to the web. Apparatus of that type is described in U.K. Pat. Nos. 1,262,116; 1,370,708; 1,399,394; 1,513,517 and 1,540,409. However, as excessive tension in a web can cause the web to break, it is desirable to incorporate means for sensing web tension to ensure that the tension is kept within permissible limits. U.K. Pat. No. 1,262,116 includes a tension sensing system which includes strain gauges and U.K. Pat. No. 1,540,409 describes mechanically movable means for limiting tension in the web. Where a web, such as paper for use with computer print-out machines, is formed with numerous evenly spaced transverse perforations, tension applied thereto must be kept minimal otherwise the web will tear along the perforations. Therefore where such web is to be printed, machines which increase or decrease tension to correct misregistration are not ideally suitable as the tension increase necessary may cause tearing along the perforations, the upper tension limit capable of being withstood by the perforations often being quite unpredictable.

An object of the present invention is to provide an improved apparatus which reduces the foregoing disadvantages.

According to the present invention, there is provided apparatus for varying the position of an operation performed on an elongate moving element comprising means for performing the operation on the moving element, feed means and take-up means for the element, sensor means for sensing the relative positioning of the element and the operation performed thereon and means operable in response to the sensor means for controlling the feed means and take-up means so that if said relative positioning is incorrect the feed means and take-up means are controlled simultaneously so as to move the element relative to the means for performing said operation substantially without varying any tension in the web between the feed means and take-up means.

Normally, initial tension will be applied to the element particularly where the element takes the form of a pre-printed paper web. Where such a web has transverse perforations, the initial tension is set below that which will tear the perforations. When varying the position of the web there will be substantially no change in the tension set initially and so the danger of tearing when correcting misregistration is substantially avoided. This is particularly advantageous as there is no need to incorporate strain gauges or mechanical tension sensing means to prevent excessive tension being applied when correcting misregistration.

Preferably the feed means and take-up means are driven by drive means common to both and the drive means may transmit drive to the feed means and take-up means through an infinitely variable transmission controlled by said means operable in response to said sensor means. In such a case, the drive means may include a drive output which transmits drive to an input shaft of the infinitely variable transmission and which also transmits drive through transmission means to said means for performing the operation of the element Drive to the take-up means is preferably transmitted through a slipping-type clutch which enables a predetermined working tension to be applied to the element. By increasing the take-up speed through the clutch, the working tension will remain substantially constant as the feed rate of the feed means is increased or decreased by the same amount.

Preferably the feed means includes a feed roller for feeding an element in the form of an elongate web, the take-up means includes a takeup roller and the means for performing an operation on the element includes printing cylinders between which the web passes with sliding contact to enable a printing operation to be performed on it, the feed and take-up rollers being arranged to increase or decrease the rate at which the web passes between the printing cylinders to vary the position of the web relative to the printing cylinders and thereby varying the position at which print is applied to the web. The printing cylinders preferably include a blanket cylinder and an impression cylinder, the impression cylinder being driven through the infinitely variable transmission so that its peripheral speed in use will always be the same as the peripheral speeds of the feed and takeup rollers, and the blanket cylinder being driven from the drive shaft of the drive means through transmission means. The sensor means may comprise a first sensor for sensing the position of the web and a sensored sensor which senses the rotary position of the blanket cylinder, a rotary member being provided which is driven by the drive means at the same rotational speed as the blanket cylinder or at a rotational speed proportional to that of the blanket cylinder, the rotary member being co-operable with the second sensor to enable the second sensor to provide a signal which effectively indicates the rotary position of the blanket cylinder. Signals from said first and second sensors may be fed to comparator means such as a micro-processor which provides an output used to control the infinitely variable transmission.

Means for arranging the web in a predetermined manner may be arranged to receive the web from the take-up means and may be driven by the said drive means so that it operates at the same rate as the take-up means. In that manner, a web issuing from the take-up means can, say, be folded and stacked at a rate consistent with the feed and take-up rate of the web.

In another embodiment the feed means and take-up means are driven by drive means in the form of a motor common to both and the means for performing the operation on the element is driven by a further motor, said means operable in response to said sensor means being arranged to control the relative speeds of the motors.

According to another aspect of the invention there is provided a method of varying the position of an operation performed on an elongate moving element comprising feeding the element at a desired rate, performing the operation on the fed element, taking up the element on which the operation has been performed, sensing the relative positions of the element and the operation performed thereon, and adjusting the rate of feed and take up simultaneously to move the element relative to the means for performing the operation substantially without varying any tension in the element if the aforesaid relative positions are incorrect.

Figure 2:
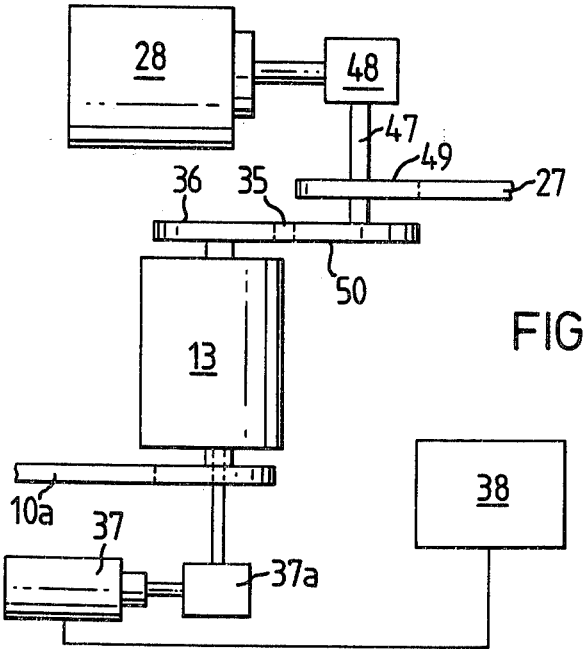
Figure 3:
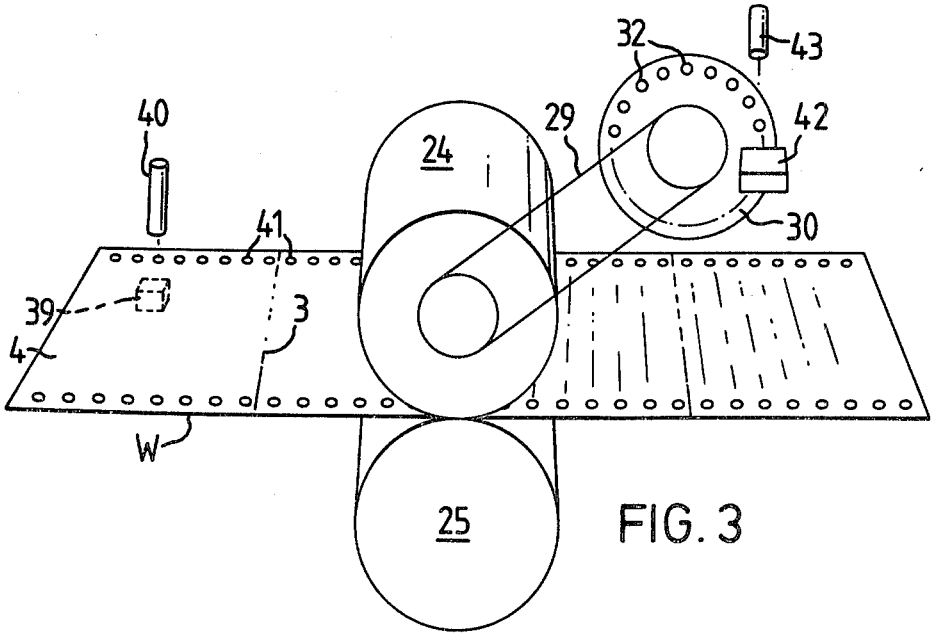
Figure 4:
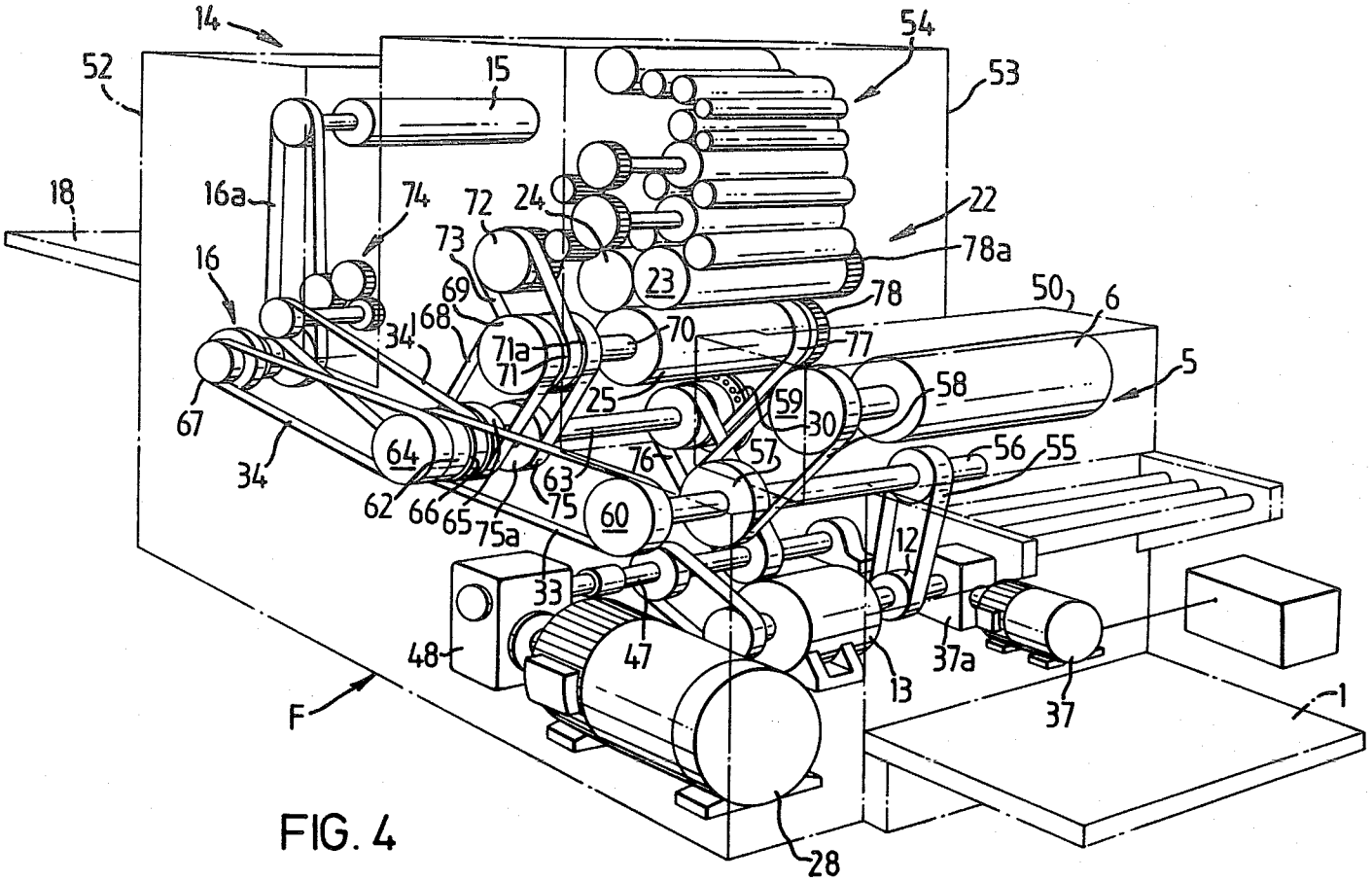
Figure 5:
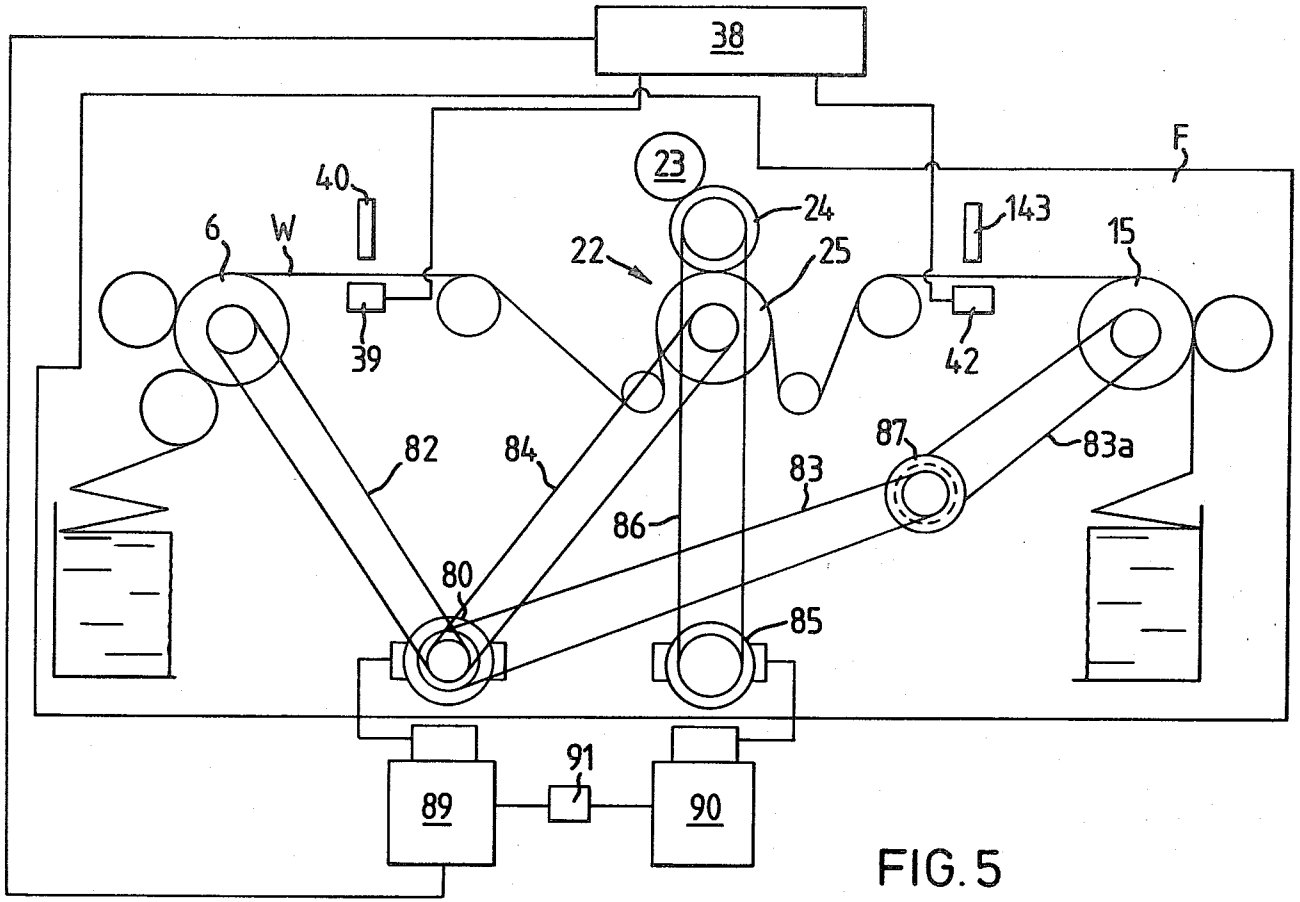

Three embodiments of apparatus in accordance with the invention will now be described with reference to the accompanying drawings in which:

FIG. 1 is a diagrammatic elevation of apparatus in accordance with the invention for printing paper web, FIG. 2 is a diagrammatic view of a drive system for use with the apparatus of FIG. 1, FIG. 3 is a diagrammatic perspective view showing sensor means for the web and print unit, FIG. 4 is a diagrammatic perspective view of apparatus, similar to that of FIG. 1 showing a typical working layout, and FIG. 5 is a diagrammatic elevation of further apparatus in accordance with the invention for printing paper web.

The apparatus of FIGS. 1 to 3 includes a main frame or bed F carrying a storage hopper or platform 1 for a stack of paper 2. The stack comprises a web W formed with lines of transverse perforations 3 which divide the web into inter-connected sheets 4. The stack is formed by arranging the sheets in concertina fashion.

A feed unit 5 comprises a main feed roller 6 and pressure rollers 7, 8 rotatably mounted on the frame F. The feed roller 6 has a toothed pulley 9 at one end which is driven through a toothed belt 10 by a toothed output pulley 12 of an infinitely variable transmission indicated generally at 13.

A take-up unit 14 includes a main take-up roller 15 rotatably mounted on the frame F and an associated pressure roller 15*a*. The roller 15 is driven through a fluid operable slipping-type clutch 16, the torque transmission characteristics of which can be varied by fluid under pressure P fed to the clutch via a control valve 17. The drive to the clutch 16 is described below. From the take-up unit 14 the web W passes to a take-up hopper or platform 18 where a concertina-like stack is formed with the aid of folding means 19.

Between the feed unit 5 and the take-up unit 14 the web W passes through a printing unit 22 comprising the usual plate cylinder 23, blanket cylinder 24 and impression cylinder 25. The cylinders are mounted on the frame F, the cylinders 23, 24 preferably being mounted on an axially slidable breach-loading unit (not shown) enabling them to be withdrawn axially to one side of the impression cylinder for access. The blanket cylinder 24 has a toothed pulley 26 at one end which is driven by a toothed belt 27 from a main motor 28. A suitable transmission (indicated diagrammatically by line 29) transmits drive from the blanket cylinder 24 to a wheel 30 formed with equi-spaced apertures 32 on a pitch circle coaxial with the wheel. Preferably one revolution of the blanket cylinder will result in one revolution of the wheel 30 or the ratio may be different. The web is held against the impression cylinder by a pressure roller 31. Instead of transmitting drive to the wheel 30 from the blanket cylinder, drive may be transmitted to the wheel 30 from the motor 28 by other transmission means in synchronism with the blanket cylinder.

Suitable drive transmissions (indicated generally by lines 33 and 34) are arranged respectively between the feed roller 6 and the impression cylinder 25, and clutch 16. The transmission 33 ensures that the peripheral speeds of the feed roller 6 and impression cylinder 25 will always be equal and the transmission 34 ensures that any change in peripheral speed of the roller 6 and impression cylinder 25 is transmitted to the clutch 16 and hence to take-up roller 15. Preferably a transmission 34' is provided between the impression cylinder 25 and the folding means 19 so that the folding means will be driven in synchronism with the web. The transmissions 33, 34 and 34' can be belt, chain, gear or any other suitable type.

Drive from the motor 28 is also transmitted through a toothed belt 35 to a toothed input pulley 36 (FIG. 2) of the infinitely variable transmission 13. The ratio between the drive input and drive output of the transmission is controlled by a servo motor 37, the latter being controlled electrically by a micro-processor 38 as described below.

A first light sensor 39 is arranged immediately beneath one of two lines of sprocket holes 41 (FIG. 3) extending along margins of the web. The spacing between centres of adjacent apertures 32 in the wheel 30 corresponds to the spacing between centres of adjacent sprocket holes e.g. half an inch (12.7 mm). A light source 40 is arranged above the web and projects a light beam towards sensor 39.

A second light sensor 42 is arranged behind the apertured wheel 30 and a second light source 143 is arranged to direct a beam of light towards the sensor 42 through the apertures so that the beam reaching the sensor 42 will be intermittent during rotation of the wheel 30.

Signals from the sensors 39, 42 are fed to the microprocessor 38 which compares the signals and makes any adjustments in web speed necessary to correct misregistration.

In use, the apparatus is initially set up so that the web follows the path shown, the web passing around guide rollers 43, 44, 45 and 46. The control valve 17 of the clutch 16 is adjusted so that with the web in motion, the rotation of the clutch through transmission 34 will rotate the roller 15. The clutch tends to drive the roller 15 so that its peripheral speed would be greater than the web feeding speed. However, the clutch permits slipping to occur so that the peripheral speed of the roller 15 remains the same as the web feeding speed. Such arrangement creates a tension in the web which is constant throughout the web between the feed and take-up rollers 6, 15. positioned relative to the blanket cylinder 25 so that the printed matter will be applied to the sheets 4 in the exact desired position. The size of the blanket cylinder 25 is accurately selected so that it will print the matter on one sheet or a predetermined number of sheets during one revolution as the web moves between the blanket and impression cylinders.

The light sensor 39 and source 40 are then aligned exactly with a sprocket hole 41 on the web and the light sensor 42 and source 143 are aligned exactly with an aperture in the wheel 30. The micro-processor 38 is arranged so that the signal from the sensor 42 forms a datum with which the signal from sensor 39 will be compared.

The variable transmission 13 is adjusted so as to feed the web at the peripheral speed of the blanket cylinder 24. Therefore, initially, the blanket cylinder will print the sheets in the desired position. With the apparatus in motion the print should, in theory, always be applied in the right position on each sheet. However, if the length of each sheet varies slightly, as is a common occurrence, the printed matter will begin to drift relative to the marginal perforations. The micro-processor is programmed to count the number of apertures 32 passing sensor 42 and to compare that number with the number of sprocket holes 41 passing over the sensor 39. The micro-processor may be programmed to make a comparison, say, every ten apertures. Provided that ten sprocket holes have also passed over sensor 39, no misregistration is occurring. However, if the individual sheets of the web W are slightly longer than their theoretical length and less than ten holes have cross sensor 39, drift is occuring and the micro-processor sends a signal to the servo motor 37 to speed up the feed and take up rollers together with the impression cylinder. However, unlike prior art machines, the increase in speed does not result in any or at least any significant increase in tension in the web because the change in speed is imported to the whole of the web between the feed and take up rollers 6, 15. The web W is in sliding contact with the blanket cylinder 24 which offers negligible resistance to movement of the web when the when speed changes. Moreover the actual amount of relative movement between the blanket cylinder 24 and the web will be very small to correct misregistration in its early stages. By maintaining substantially constant tension in the web there is substantially no addition strain placed on the perforations 3 in the web and the possibility of tearing is largely avoided. Operation of the servo motor 37 continues until the sensors 39, 42 read equal numbers of holes again. Where misregistration occurs because the individual sheets of the web are slightly shorter than their theoretical length, the sensor 37 will sense more than ten sprocket holes for every ten apertures passing sensor 42. The servo motor is then operated to reduce the web speed. The apparatus is very accurate and senses and corrects misregistration early enough to avoid smudging visible to the naked eye.

It will be appreciated that the sensor 42 is effectively sensing the rotary position of the blanket cylinder 24 as the wheel 30 is driven directly from it. Therefore the sensors 39, 42 together sense the relative positions of the web and print applied to the web.

A typical drive arrangement for the apparatus is shown in FIG. 2 where the main motor 28 drives a primary shaft 47 through a gear box 48.

The shaft 47 carries toothed pulleys 49, 50 the former driving the blanket cylinder 24 through belt 27 and the latter driving the toothed input pulley 36 of the variable transmission 13 through the belt 25. The variable transmission is preferably of the type known as a Harmonic Drive manufactured by Harmonic Drives Inc. of Tokyo Japan. However, other forms of variable transmission such as a variable epicyclic gearing could be used. With the Harmonic Drive, the input pulley 36 drives the output pulley 12 through an elliptical toothed band (not shown) supported by a bearing incorporating a rotary ratio control member drivable by the servo motor 37 through a gear box 37*a*. The operation of the servo motor will vary the input speed to output speed ratio infinitely within a set range so that the web W can be transported relative to or at the same speed as the blanket cylinder depending on the signal received from the microprocessor 38.

FIG. 4 shows a typical working arrangement for the apparatus of FIGS. 1 to 3 and in FIG. 4 parts corresponding to parts in FIGS. 1 to 3 have the same reference numerals.

The bed F carries the platforms 1 and 18 for the paper web (not shown). The feed unit 5 is arranged in a housing 50 and the paper (not shown) passes over the feed roller 6. The take-up unit 14 is also arranged in a housing 52 and includes the take up roller 15. Pressure rollers are omitted for clarity. The printing unit 22 is arranged in a housing 53 and the plate cylinder, blanket cylinder and impression cylinder are indicated at 23, 24 and 25. A number of inking rollers indicated generally at 54 are provided in known manner.

The apparatus is driven from the motor 28 which drives the primary shaft 47 through gear box 48 as in FIG. 2. The servo motor 37 controls the Harmonic Drive unit or other infinitely variable transmission 13 through a gear box 37*a*.

The toothed output pulley 12 of the transmission 13 is connected by a toothed belt 55 to a layshaft 56. The layshaft carries a toothed pulley 57 which is connected by a toothed belt 58 to a toothed pulley 59 rotatably fast with the feed roller 6.

The layshaft 56 carries a further toothed pulley 60 which transmits drive through a toothed belt 33 to a toothed pulley 62 on a further layshaft 63. The pulley 62 is rotatably fast with an outer toothed pulley 64, and inner toothed pulleys 65, 66. The pulleys 62, 64, 65 and 66 are freely rotatable on layshaft 63. The pulley 64 is connected via a toothed belt 34 to a toothed pulley 67 for driving clutch 16. The clutch 16 drives take-up roller 15 through toothed belt 16*a*. The pulley 65 is connected via a toothed belt 68 to a toothed pulley 69 rotatably fast with a shaft 70 carrying the impression cylinder 25. The shaft 70 also carries a toothed pulley 71 drivably connected by a toothed belt 73 to a toothed pulley 72 for driving the numerous inking rollers 54. The pulley 71 is drivably connected to an adjacent toothed pulley 71*a*, both pulleys being freely rotatable on the shaft. The pulley 71*a* is driven by a toothed belt 75 from a toothed pulley 75*a* rotatably fast with shaft 63. The pulley 66 drives gears 74 for the web folding means (not shown in FIG. 4) through a toothed belt. It will be seen, therefore, that the feed roller 6, take-up roller 15, impression cylinder 25 and the folding means are all driven from the output of the infinitely variable transmission 13.

The primary shaft 47 drives the layshaft 63 through a toothed belt 76. Drive is transmitted from the layshaft by a toothed belt 77 to a gear 78 freely rotatable on the shaft 70. The gear 78 meshes with one of two meshing gears 78*a* (one only of which is shown) on the plate and blanket cylinders 23 and 24. In that manner the layshaft 63 drives the plate and blanket cylinders. In FIG. 4, the plate 30 is rotatably fast with layshaft 63 and is therefore driven in synchronism with the blanket cylinder.

The sensors are omitted for clarity from FIG. 4 and the microprocessor 38 will normally be housed conveniently in the bed of the machine.

Reference is now made to FIG. 5 in which parts corresponding to parts shown in FIG. 1 carry the same reference numerals.

As in FIG. 1, there are feed and take-up rollers 6 and 15 which transport the web W through a printing unit 22 comprising plate, blanket and impression cylinders 23, 24 and 25. In the embodiment the feed roller; take up roller and impression cylinder are driven by a first motor 80 through belts 82; 83,83*a* and 84 respectively and the blanket cylinder 24 is driven by a second motor 85 through a belt 86. The motors have respective controllers 89, 90. A slipping-type clutch 87 is provided in the drive to the take up roller 15. A sensor 39 with a light source 40 senses the sprocket holes in web W. A further sensor 42 with a light source 143 senses the position at which print is applied to the web either by means similar to that shown in FIG. 1 or by sensing a print mark applied to the web in the printing unit. Signals from the sensors are fed to a comparator such as the micro-processor 38 which applies output signals to a control box 89 for varying the speed of motor 10 and hence the speed of the web relative to the blanket cylinder 24 without substantially changing the tension in the web W. The speed of the motors can be controlled simultaneously to increase or decrease the speed of the entire apparatus by a coarse control potentimeter 91.

Although I prefer to print with tension applied to the web, the tension may be zero or substantially zero.

Although specific reference has been made to a web formed with lines of sprocket holes 41, the web may be of a non-sprocket hole type having marks applied thereto to be picked up by sensor 39. Moreover the print unit could be replaced by another type of unit for carrying out some other operation, e.g. scoring or perforating, on a pre-processed web.

The web may be replaced by some other elongage element such as a narrow tape or filament on which some operation is to be performed at precise intervals.

Instead of using a light source 40 and an associated sensor 39, a sensor may be used which directs a light beam towards the web and then receives the reflected beam. Such a reflected beam will be interrupted by the sprocket holes as the web moves past the sensor and in that way the sprocket holes can be counted. A similar system may be used in place of sensor 42 and light source 143.

What I claim as my invention and desire to secure by Letters Patent in the United States is:

1. Apparatus for varying the position of an operation performed on an elongate moving element comprising means for performing the operation on the moving element, feed means and take-up means for the element, infinitely variable transmission having an output from which drive is transmitted to both said feed means and take-up means simultaneously whereby the rate of feed and take-up will always be controlled by said infinitely variable transmission, sensor means for sensing the relative positioning of the element and the operation performed thereon and means operable in response to said sensor means for controlling the infinitely variable transmission so that if said relative position is incorrect the feed means and take-up means are controlled simultaneously by the output of said variable transmission so as to move the element relative to the means for performing the operation substantially without varying any tension in the web between the fed means and take-up means.

2. Apparatus for varying the position of an operation performed on an elongate moving element comprising means for performing the operation on the moving element which means comprises first and second members between which the element passes to enable the first member to perform said operation, a web transport surface on said second member, feed means and take-up means for the element, infinitely variable drive means for driving said feed means and said take-up means and said second member simultaneously whereby the rate of feed and take-up of the web and the speed of the web transport surface will always be the same, further drive means for said first member, sensor means for sensing the relative positioning of the element and the operation performed thereon and means operable in response to said sensor means for controlling the infinitely variable transmission so that if said relative position is incorrect the feed means, take-up means and second member are controlled simultaneously so as to move the element relative to said first member substantially without varying any tension in the web between the feed means and the take-up means.

3. Apparatus according to claim 1 or 2 in which the feed means includes a feed roller for feeding an element in the form of an elongate web, the take-up means includes a take-up roller and the means for performing an operation on the element includes printing cylinders between which the web passes in contact therewith to enable a printing operation to be performed.

4. Apparatus according to claim 2 in which the drive means includes a drive motor having a drive output shaft, and an infinitely variable transmission having an input driven by said drive output shaft, and an output which drives said feed means, second member and take-up means, said drive output shaft of said drive motor comprising said further drive means arranged to drive said first member through further transmission means.

5. Apparatus for varying the position of an operation performed on an elongate moving web comprising printing cylinders between which the web passes in contact therewith to enable a printing operation to be performed on it, feed and take-up rollers for the web, drive means for said feed and take-up rollers, the feed and take-up rollers being arranged to increase or decrease the rate at which the web passes between the printing cylinders to vary the position at which print is applied to the web, the printing cylinders including a blanket cylinder and an impression cylinder, an infintely variable transmission through which drive is transmitted from the drive means to the feed and take-up rollers and the impression cylinder so that the peripheral speed of the impression cylinder in use will always be the same as the peripheral speeds of the feed and take-up rollers, the blanket cylinder being driven from a drive shaft of the drive means through transmission means, sensor means for sensing the relative positioning of the web and the print applied thereto and means operable in response to said sensor means for controlling the feed and take-up rollers so that if the position at which the print is applied to the web is incorrect the feed rollers, takeup rollers and impression cylinder are controlled simultaneously so as to move the web relative to the blanket cylinder substantially without varying any tension in the web between the feed and take-up rollers.

6. Apparatus for varying the position of a printing operation performed on an elongate moving web comprising printing cylinders between which the web passes to enable the printing operation to be performed on it, feed and take up rollers for the web, drive means for said feed and take up rollers, an infinitely variable transmission through which drive is transmitted from drive means to both said feed and take up rollers, said cylinders including a blanket cylinder and an impression cylinder, said cylinder being driven through the infinitely variable transmission so that its peripheral speed in use will always be the same as the peripheral speeds of said feed and take up rollers, and said blanket cylinder being driven from a drive shaft of said drive means through transmission means, a first sensor for sensing the position of the web, a second sensor for sensing the rotary position of the blanket cylinder, a rotary member being provided which is driven by the drive means at the same rotational speed as the blanket cylinder or at a rotational speed proportional to the blanket cylinder, the rotary member being co-operable with the second sensor to enable the second sensor to provide a signal which effectively indicates the rotary position of the blanket cylinder, and means operable in response to the first and second sensors for controlling the infinitely variable transmission so that if the relative positioning of the web and the blanket cylinder is incorrect the feed and take up rollers and the impression cylinder are controlled simultaneously so as to slide the web relative to the blanket cylinder substantially without varying any tension in the web between the feed and take-up rollers.

7. Apparatus according to claim 6 in which said means operable in response to the first and second sensors comprises comparator means and signals from said first and second sensors are fed to said comparator means which provides an output used to control the variable transmission.

* * * * *